US007976004B2

(12) United States Patent
Kimura

(10) Patent No.: US 7,976,004 B2
(45) Date of Patent: Jul. 12, 2011

(54) SHEET TAMPER AND DUAL MOVING AND PRESSING UNITS FOR FINISHER

(75) Inventor: Masatoshi Kimura, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 163 days.

(21) Appl. No.: 12/354,450

(22) Filed: Jan. 15, 2009

(65) Prior Publication Data

US 2009/0250861 A1 Oct. 8, 2009

(30) Foreign Application Priority Data

Apr. 4, 2008 (JP) ..... 2008-097816

(51) Int. Cl.
*B65H 37/04* (2006.01)

(52) U.S. Cl. ..... 270/58.11; 270/58.08; 270/58.16

(58) Field of Classification Search ..... 270/58.08, 270/58.11, 58.12, 58.13, 58.14, 58.16, 58.17
See application file for complete search history.

(56) References Cited

U.S. PATENT DOCUMENTS

| | | | | |
|---|---|---|---|---|
| 6,145,825 | A * | 11/2000 | Kunihiro et al. | 270/58.09 |
| 6,889,971 | B2 * | 5/2005 | Tamura et al. | 270/58.11 |
| 7,520,505 | B2 * | 4/2009 | Thomas et al. | 271/220 |
| 2004/0183249 | A1 * | 9/2004 | Sato | 271/220 |
| 2007/0069453 | A1 * | 3/2007 | Thomas et al. | 271/207 |

FOREIGN PATENT DOCUMENTS

| | | |
|---|---|---|
| JP | 11-130338 | 5/1999 |
| JP | 2002-068574 | 3/2002 |
| JP | 2002-241029 | 8/2002 |

* cited by examiner

*Primary Examiner* — Patrick Mackey
(74) *Attorney, Agent, or Firm* — Morgan, Lewis & Bockius LLP

(57) ABSTRACT

A finishing device with an output unit that outputs a recorded sheet on which an image is recorded, a sheet stacker that receives the recorded sheet from the output unit and on which the recorded sheet is stacked, and a reference surface against which the recorded sheet on the sheet stacker is aligned. A binding unit binds a bundle of the recorded sheets aligned against the reference surface and a sheet pressing member presses an end portion of the recorded sheet toward the sheet stacker. The end portion is closer to the reference surface, and a first moving and pressing unit moves the recorded sheet toward the reference surface while the sheet pressing member presses the end portion of the recorded sheet.

14 Claims, 8 Drawing Sheets

SHEET TAMPER AND DUAL MOVING AND PRESSING UNITS FOR FINISHER

CROSS REFERENCE TO RELATED APPLICATIONS

This application is based on and claims priority under 35 USC §119 from Japanese Patent Application No. 2008-097816 filed Apr. 4, 2008.

BACKGROUND

1. Technical Field

The present invention relates to a finishing apparatus for processing sheets, a sheet processing system and a sheet alignment method.

2. Related Art

A finishing apparatus for performing a sheet bundle binding process has been proposed.

SUMMARY

According to an aspect of the invention, there is provided a finishing apparatus including: an output unit that outputs a recorded sheet on which an image is recorded; a sheet stacker that receives the recorded sheet from the output unit and on which the recorded sheet is stacked; a reference surface against which the recorded sheet on the sheet stacker is aligned; a binding unit that binds a bundle of the recorded sheets aligned against the reference surface; a sheet pressing member that presses an end portion of the recorded sheet toward the sheet stacker, the end portion being closer to the reference surface; and a first moving and pressing unit that moves the recorded sheet toward the reference surface while the sheet pressing member presses the end portion of the recorded sheet, the end portion being closer to the reference surface.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present invention will be described in detail, with reference to the attached drawings.

First Exemplary Embodiments

Figure 1:
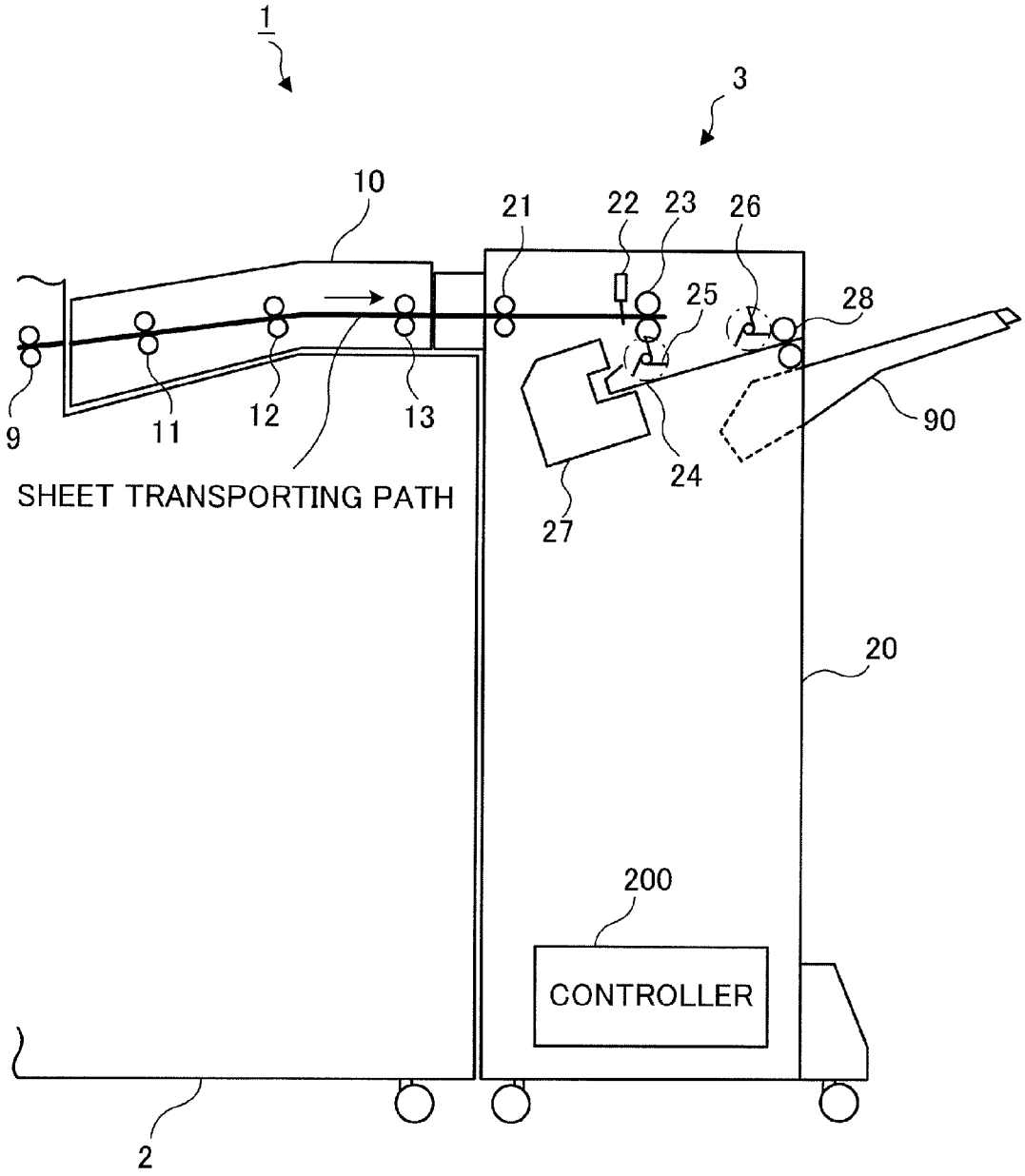
FIG. 1 is a diagram showing an entire configuration of a sheet processing system to which the first exemplary embodiment is applied.

FIG. 1 is a diagram showing an entire configuration of a sheet processing system 1 to which the first exemplary embodiment is applied. The sheet processing system 1 shown in FIG. 1 includes an image forming apparatus 2 such as a printer or a copy machine that forms a color image with, for example, an electrophotographic method, and a sheet processing apparatus 3 that performs finishing process on a recorded sheet (hereinafter, the "recorded sheet" is simply referred to as a "sheet") on which an image is recorded by the image forming apparatus 2. The sheet processing apparatus 3 includes a transport unit 10 that further transports a sheet outputted from the image forming apparatus 2 toward a downstream side, and a finishing apparatus 20 having, for example, a stapler for edge-binding, a compile tray that collects and binds sheets, and the like. In addition, the sheet processing apparatus 3 includes a stacker tray 90 that stacks sheet bundles after the finishing process so that a user easily takes them away. Further, the sheet processing apparatus 3 has a controller 200 that controls the sheet processing apparatus 3 entirely. The controller 200 is provided in, for example, the finishing apparatus 20.

As shown in FIG. 1, the transport unit 10 of the sheet processing apparatus 3 has entrance rollers 11 as a pair of rollers receiving a printed sheet which is outputted via output rollers 9 of the image forming apparatus 2, a first transport rollers 12 as a pair of rollers transporting the sheet toward a downstream side, and a second transport rollers 13 as a pair of rollers transporting the sheet toward the finishing apparatus 20.

The finishing apparatus 20 of the sheet processing apparatus 3 includes receiving rollers 21 as a pair of rollers receiving the sheet from the transport unit 10 and an exit sensor 22 that is provided on a downstream side of the receiving rollers 21 and that detects the sheet. Further, the finishing apparatus 20 includes a compile tray 24 that collects and contains plural sheets, and exit rollers 23 as a pair of rollers outputting a sheet toward the compile tray 24. Furthermore, the finishing apparatus 20 includes a main paddle 25 and a sub paddle 26 as rotating paddles for pushing a trail edge of the sheet toward an end guide (described later) of the compile tray 24, and a stapler 27 for binding an end of a sheet bundle. Furthermore, the finishing apparatus 20 includes eject rollers 28 that transport the sheet bundle stacked on the compile tray 24 toward the stacker tray 90.

Figure 2:
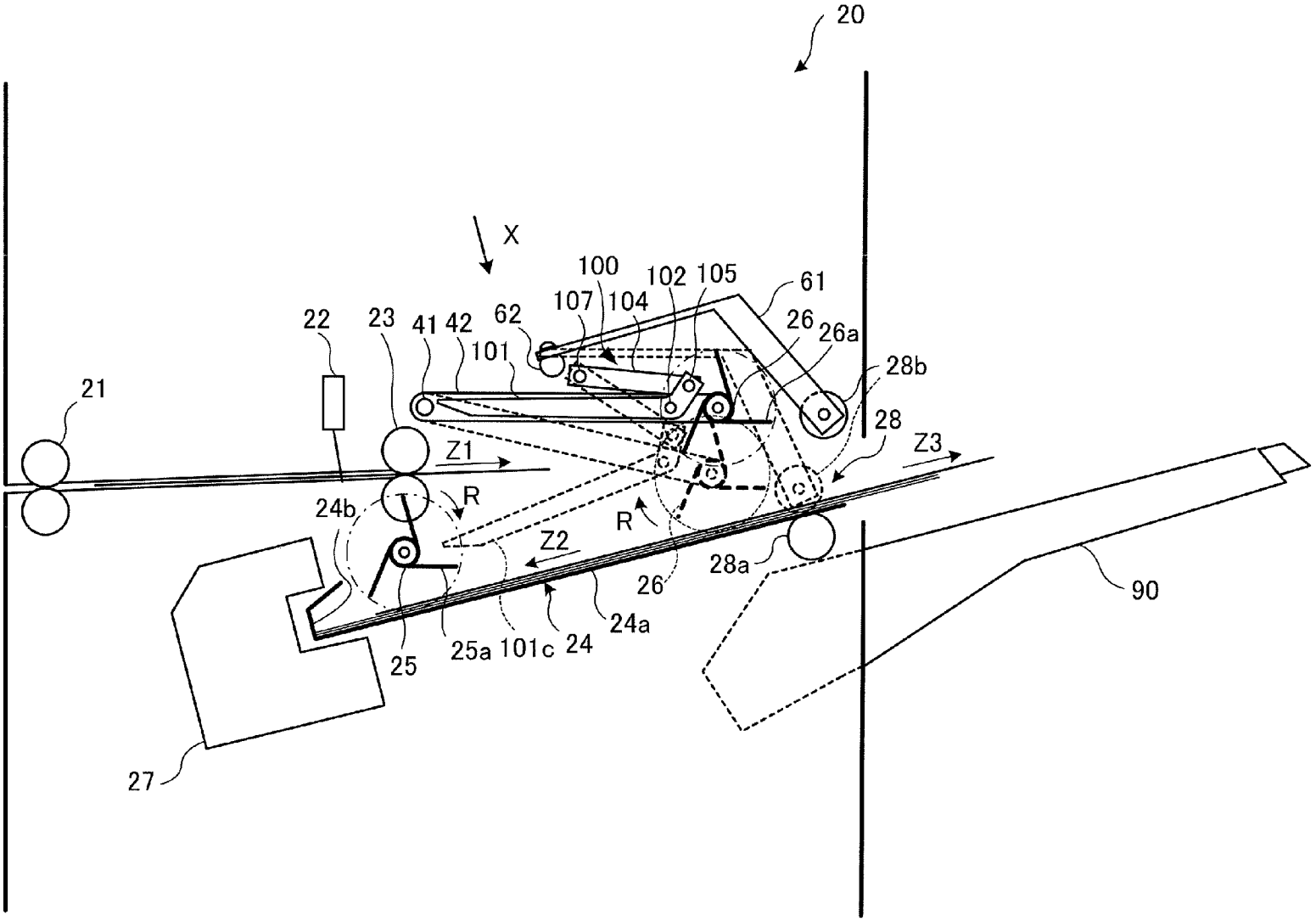
FIG. 2 is a view for further describing a configuration of the finishing apparatus in detail.

FIG. 2 is a view for further describing a configuration of the finishing apparatus 20 in detail.

Figure 3A:
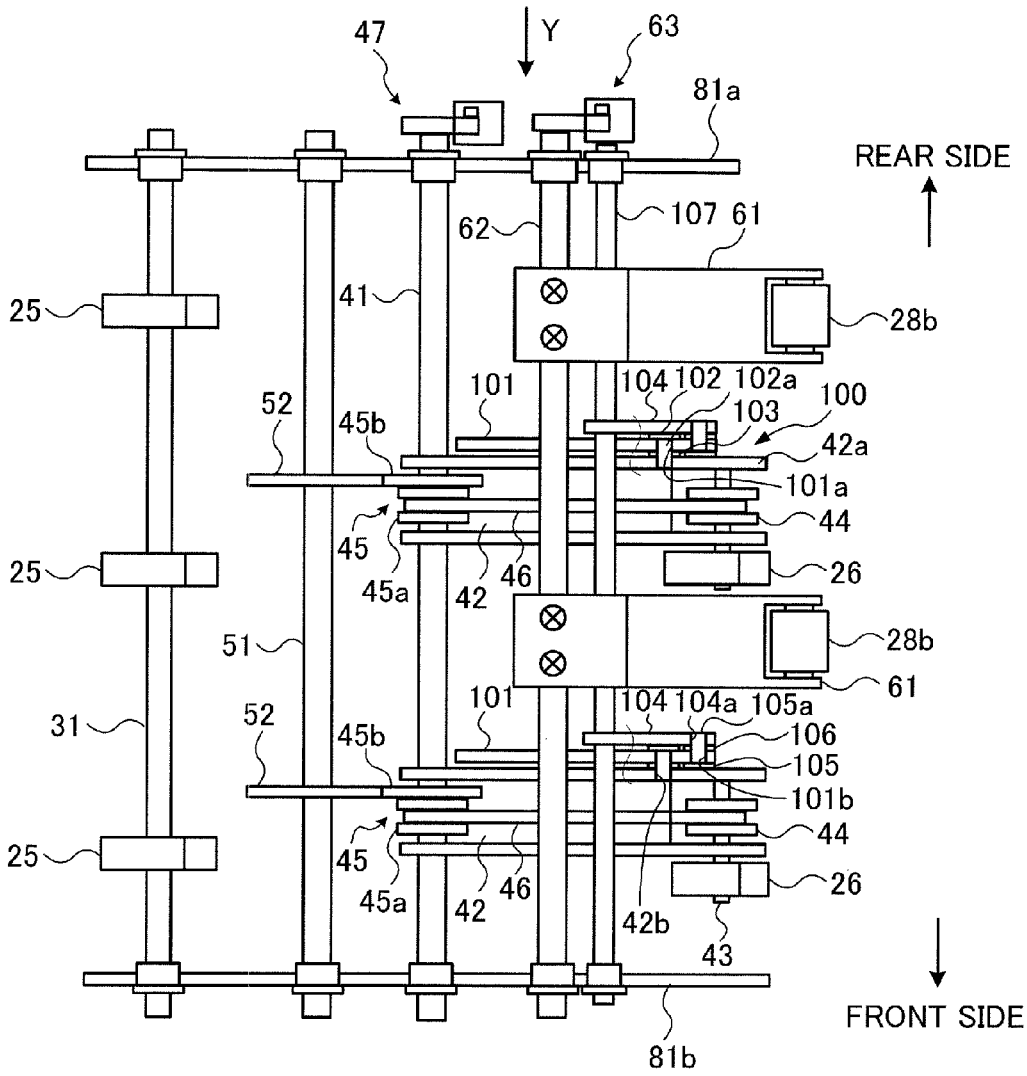
FIG. 3A is a view for explaining a configuration of the finishing apparatus in a direction orthogonal to the sheet transporting direction, and is a view principally taken in an arrow X direction in FIG. 2.
Figure 3B:
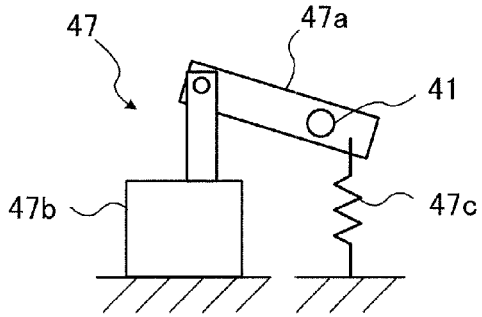
FIGS. 3B and 3C are views that are taken in an arrow direction in FIG. 3A.
Figure 3C:
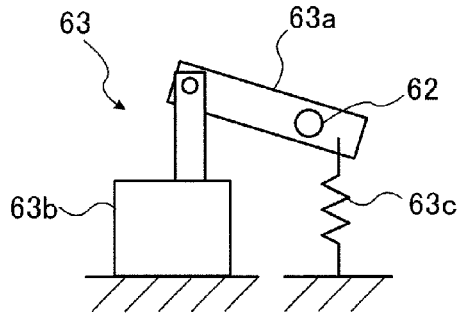

FIG. 3A is a view for explaining a configuration of the finishing apparatus 20 in a direction orthogonal to the sheet transporting direction, and is a view principally taken in an arrow X direction in FIG. 2. FIGS. 3B and 3C are views that are taken in an arrow Y direction in FIG. 3A.

First, the compile tray 24 has a sheet stacker 24*a* that receives a sheet from the exit rollers 23 serving as an output unit and stacks it thereon, and an end guide 24*b* that is formed perpendicular to the sheet stacking surface of the sheet stacker 24*a*. The end guide 24*b* is a reference surface as a reference for aligning edges of sheets when the sheets outputted from the exit rollers 23 are aligned. By hitting the edges of the sheets against the end guide 24*b*, a sheet bundle is produced.

Next, a description will be given of the main paddle 25.

The main paddle 25 has three flexible sheet contact portions 25*a* as shown in FIG. 2, comes into contact with a top surface of a sheet (or a top surface of a sheet bundle) and transports the sheet toward the end guide 24*b*. That is, the main paddle 25 corresponds to a (first) moving and pressing unit that moves the sheet toward the end guide 24*b* and presses the sheet against the end guide 24*b*, on the sheet stacker 24*a*, and also corresponds to a first moving and pressing member that moves the sheet toward the end guide 24*b* and presses the sheet against the end guide 24*b* by coming into contact with the sheet on the sheet stacker 24*a* and rotating.

Further, above the compile tray 24 around the end guide 24*b*, a main paddle supporting shaft 31 is rotatably supported by finishing apparatus frames 81*a* and 81*b* of the finishing apparatus 20 (refer to FIG. 3A). To the main paddle supporting shaft 31, plural main paddles 25 (in the first exemplary embodiment, three main paddles 25) are fixedly supported at intervals in a direction orthogonal to the sheet transporting direction. The main paddle supporting shaft 31 is driven to be rotated by a drive motor (not shown in the figure) arranged on a rear side of the apparatus. Along with the rotation of the main paddle supporting shaft 31, the main paddle 25 also rotates. Then, by the rotation of the main paddle 25 in an R direction in FIG. 2, a sheet transported toward a Z1 direction in FIG. 2 is pushed in a Z2 direction on the sheet stacker 24*a*.

Next, a description will be given of the sub paddle 26.

The sub paddle 26 has three flexible sheet contact portions 26*a* as shown in FIG. 2, and comes into contact with a top surface of the sheet (or a top surface of a sheet bundle) on the sheet stacker 24*a* and transports the sheet toward the end guide 24*b*. That is, the sub paddle 26 corresponds to a second moving and pressing member that moves a sheet toward the end guide 24*b* on the sheet stacker 24*a*, and also corresponds to a second moving and pressing member that moves the sheet toward the end guide 24*b* and presses the sheet against the end guide 24*b* by coming into contact with the sheet on the sheet stacker 24*a* and rotating.

Above the compile tray 24, a sub paddle supporting shaft 41 as a rotating shaft is rotatably supported by the finishing apparatus frames 81*a* and 81*b* at a position away from the sheet stacking surface of the sheet stacker 24*a* in a direction orthogonal to the sheet stacking surface, compared to the exit rollers 23 (refer to FIG. 3A). To the sub paddle supporting shaft 41, one end portions of plural sub paddle supporting members 42 (in the first exemplary embodiment, one end portions of two sub paddle supporting members 42) are fixedly supported as a first rotation member extending toward the stacker tray 90 at intervals in the direction orthogonal to the sheet transporting direction. On the other end portions of the sub paddle supporting members 42, which are closer to the stacker tray 90, sub paddle supporting arms 42*a* are formed. To the sub paddle supporting arm 42*a*, the sub paddle 26 is rotatably supported via the sub paddle rotating shaft 43. To the sub paddle rotating shaft 43, a pulley 44 is fixedly supported. Further, to the sub paddle supporting shaft 41, a drive side pulley 45 located so as to correspond to the pulley 44 is rotatably supported. The drive side pulley 45 has a pulley portion 45*a* and a gear portion 45*b*. Between the pulley 44 and the pulley portion 45*a*, a sub paddle driving belt 46 is mounted.

At an end portion of the sub paddle supporting shaft 41 on the rear side of the apparatus, a sub paddle swinging member 47 is provided. As shown in FIG. 3B, the sub paddle swinging member 47 has a swinging bar 47*a*, a solenoid 47*b* for swinging the sub paddle, and a pulling spring 47*c*. According to the rotation of the sub paddle supporting shaft 41 with respect to the finishing apparatus frames 81*a* and 81*b* by turning on or off the solenoid 47*b* for swinging the sub paddle, the sub paddle supporting member 42 swings around the sub paddle supporting shaft 41 as a center axis. Thereby, the sub paddle 26 supported by the sub paddle supporting member 42 moves between a contact position (a position indicated by broken lines in FIG. 2 (a second position)) and a retract position (a position indicated by solid lines in FIG. 2 (a first position)). The contact position is a position where the sub paddle 26 comes into contact with a sheet on the sheet stacker 24*a* of the compile tray 24, for pushing the sheet toward the end guide 24*b*, while the retract position is a position where the sub paddle 26 is retracted from the contact position so as not to be in contact with a sheet on the sheet stacker 24*a*.

It should be noted that the sub paddle swinging member 47 is not limited to the configuration of including the solenoid (47*b*) and the spring (47*c*), but is allowed to have a configuration for swinging the sub paddle 26 by using a motor and an eccentric cam, for example.

As described above, the sub paddle supporting shaft 41, the sub paddle supporting member 42, the sub paddle swinging member 47 and the like form a drive mechanism for moving the sub paddle 26 between the retract position (first position) and the contact position (second position).

On the upstream side of the sub paddle supporting shaft 41 in the sheet transporting direction, the sub paddle driving shaft 51 is rotatably supported by the finishing apparatus frames 81*a* and 81*b*. To the sub paddle driving shaft 51, drive gears 52 that are engaged with the respective gear portions 45*b* of the drive side pulleys 45 are fixedly supported. The sub paddle driving shaft 51 is driven to be rotated by a drive motor (not shown in the figure) arranged on the rear side of the apparatus. According to the driving by the drive motor, rotation is transmitted to the sub paddles 26 via the drive gears 52, the gear portions 45*b*, the pulley portions 45*a*, the sub paddle driving belts 46 and the pulleys 44, and thus the sub paddles 26 rotate. By the rotation of the sub paddles 26 in an R direction in FIG. 2, the sub paddles 26 push a sheet transported toward the Z1 direction in FIG. 2 toward the Z2 direction on the sheet stacker 24*a* of the compile tray 24.

Further, the sub paddle supporting members 42 are coupled to the respective sheet pressing mechanisms 100. The sheet pressing mechanisms 100 are provided in order to press a sheet transported toward the Z1 direction in FIG. 2, toward a sheet stacker 24*a* so as to accurately guide the sheet to a position between the main paddle 25 and the sheet stacker 24*a* of the compile tray 24.

Next, a description will be given of the sheet pressing mechanism 100. It should be noted that, to make the configuration of the sheet pressing mechanism 100 easy to understand, the sheet pressing mechanism 100 is shown on the front side compared to the sub paddle supporting member 42 in FIG. 2. The exact positional relationship in the direction orthogonal to the sheet transporting direction between the sheet pressing mechanism 100 and the sub paddle supporting members 42, for example, is as shown in FIG. 3A.

A sheet pressing member 101 is rotatably attached to each of the sub paddle supporting members 42, and moves in conjunction with the swing of the sub paddle supporting member 42. More specifically, the sheet pressing member 101 has a "V-like" shape having one side shorter than the other side as shown in FIG. 2, and a hole portion 101*a* is formed in a bend portion of the letter "V" (first supporting portion) while a hole portion 101*b* is formed in an end portion of the shorter line of the letter "V" (second supporting portion) (refer to FIG. 3A). Moreover, as shown in FIG. 3A, a shaft 102*a* of a pin 102 is loosely fitted into the hole portion 101*a* formed in the sheet pressing member 101, and a tip portion of the shaft 102*a* is press-fitted into a hole portion 42*b* formed in the sub paddle supporting member 42. Furthermore, a washer 103 is inserted between the sheet pressing member 101 and the sub paddle supporting member 42.

In addition, the sheet pressing member 101 is also rotatably supported by a coupling member 104, serving as a second rotation member, rotatably supported with respect to the finishing apparatus frames 81*a* and 81*b*. More specifically, as shown in FIG. 3A, a shaft 105*a* of a pin 105 is loosely fitted into the hole portion 101*b* formed in the one end portion of the sheet pressing member 101, and a tip portion of the shaft 105*a* is press-fitted into a hole portion 104*a* formed in one end portion of the coupling member 104. Moreover, a washer 10 is inserted between the sheet pressing member 101 and the coupling member 104. Furthermore, the other end portion of the coupling member 104 is loosely fitted around a coupling member support shaft 107 serving as a fixed shaft fixedly supported by the finishing apparatus frames 81*a* and 81*b*.

In the sheet pressing mechanism 100 having the above-described configuration, in conjunction with the movement of the sub paddles 26 from the retract position to the contact position, tip portions (a sheet pressing portion) 101*c* of the sheet pressing members 101, which is closer to the main paddles 25, tilt downward toward the sheet stacker 24*a* of the compile tray 24 (the position indicated by broken lines in FIG. 2). Thereby, the tip portions 101*c* press a sheet outputted by the exit rollers 23 in the direction Z1 shown in FIG. 2 and accurately guide the sheet to a position between the main paddles 25 and the sheet stacker 24*a*. When the sub paddles 26 are in the retract position, on the other hand, the sheet pressing members 101 are in a retract state (in the position indicated by solid lines in FIG. 2) so as not to obstruct sheets transported in the direction Z1 shown in FIG. 2.

Here, as shown in FIG. 2, when the tip portions 101*c* of the sheet pressing members 101, which is closer to the main paddle 25, are in the position indicated by the broken lines in FIG. 2, that is, the position in which the tip portions 101*c* are tilted downward toward the sheet stacker 24*a* to the largest extent, the tip portions 101*c* overlap with rotation areas of the main paddles 25 in the direction Z2 in which a sheet on the sheet stacker 24*a* is inserted. Accordingly, the tip portions 101*c* press the sheet outputted in the direction Z1 shown in FIG. 2 by the exit rollers 23, reliably, and efficiently guides the sheet to the position between the main paddles 25 and the sheet stacker 24*a*.

Next, a description will be given of the eject rollers 28.

As shown in FIG. 2, the eject rollers 28 consist of first eject rollers 28*a* and second eject rollers 289*b*. The first eject rollers 28*a* are rotatably supported by the finishing apparatus frames 81*a* and 81*b*, while fixedly supported by a rotation shaft (not shown in the figure) driven to be rotated by a drive motor not shown in the figure.

Meanwhile, the second eject rollers 28*b* are each rotatably supported by an end portion of a corresponding second eject roller supporting member 61, which is closer to the stacker tray 90. End portions of the second eject roller supporting members 61 on the upstream side in the sheet transporting direction are fixedly supported by a second eject roller supporting shaft 62 rotatably supported by the finishing apparatus frames 81*a* and 81*b*. Moreover, a second eject roller swinging member 63 is attached to an end portion of the second eject roller supporting shaft 62, the end portion being on the rear side of the apparatus. As shown in FIG. 3C, the second eject roller swinging member 63 includes: a swinging bar 63*a* coupled to the end portion of the second eject roller supporting shaft 62; a solenoid 63*b* for swinging the second eject roller, which is coupled to one end portion of the swinging bar 63*a*; and a pulling spring 63*c* coupled to the other end portion of the swinging bar 63*a*.

When the solenoid 63*b* for swinging the second eject roller is in an ON state, the second eject rollers 28*b* are each in an output position indicated by broken lines in FIG. 2, and a sheet bundle on the compile tray 24 is sandwiched and held between the second eject rollers 28*b* and the first eject rollers 28*a*. Then, the sandwiched sheet bundle is outputted to the stacker tray 90 according to the rotation of the first eject rollers 28*a*.

By contrast, when the solenoid 63*b* for swinging the second eject roller is in an OFF state, the second eject rollers 28*b* are retracted from the output position by the pulling spring 63*c*, and are consequently in a retract position (the position indicated by solid lines in FIG. 2) in which the second eject rollers 28*b* are not in contact with the sheet bundle on the compile tray 24. To produce (compile) a sheet bundle, the second eject rollers 28*b* are positioned in this retract position, so that the first eject rollers 28*a* and the second eject rollers 28*b* are spaced from each other.

Here, the second eject roller supporting members 61 may be formed of plate springs so that a sheet bundle is sandwiched and held between the second eject roller supporting members 61 and the first eject rollers 28*a* with proper pressure when positioned in the output position. The second eject roller supporting members 61 may also be formed to have high rigidity and be pressed toward the first eject rollers 28*a* by coil springs.

In addition, the second eject roller swinging member 63 is not limited to the configuration of including the solenoid (63*b*) and the spring (63*c*), but is allowed to have a configuration for swinging the second eject rollers 28*b* by using a motor and an eccentric cam, for example.

Next, a description will be given of the stapler 27 serving as a binding unit.

The stapler 27 includes: a stapler head actually performing a binding processing on a sheet bundle; a base supporting the stapler head; and a rail disposed on the base, and forming a path along which the stapler head moves. The rail is disposed along an end portion of the sheet stacker 24*a*, and the stapler head moves along the rail to perform the binding processing. The stapler 27 also includes: a stapler moving motor, which is a stepping motor, for moving the stapler head; a stapler move home sensor detecting a home position for the stapler head; and a stapler center position sensor detecting a center position for the stapler head.

In the case of performing single staple binding on a sheet bundle on the compile tray 24, the stapler head stays in a first home position detected by the stapler move home sensor, and performs the binding processing in sequence at appropriate timing.

In the case of performing double staple binding on a sheet bundle, on the other hand, the stapler head stand by in a second home position detected by the stapler center position sensor. Then, after a bundle of sheets is stacked on the compile tray 24, the stapler moving motor is driven to move the stapler head to staple positions. Thus, the bundle of sheets is subjected to the double staple binding.

Next, a description will be given of the controller 200.

Detection values obtained by various sensors such as the above-described exit sensor 22 and stapler center position sensor are inputted to the controller 200. On the basis of the inputted detection values, the controller 200 controls operations of the above-described drive motor, solenoid and stapler moving motor, and a tamper to be described later, for example.

The finishing apparatus 20 includes, although not shown in the figure, the tamper provided to the compile tray 24 in the directions orthogonal to the sheet transporting direction (between the front side and the rear side on the page showing FIG. 2). The tamper performs alignment of both edges of each sheet (both sides of each sheet in the directions orthogonal to the sheet transporting direction).

Next, a description will be given of an operation of the sheet processing system 1 having the above-described configuration.

As shown in FIG. 1, sheets each of which has an image recorded thereon by the image forming apparatus 2 are fed one by one into the sheet processing apparatus 3 through the output rollers 9 of the image forming apparatus 2. In the transport unit 10 of the sheet processing apparatus 3, each sheet received by the entrance rollers 11 is transported along the sheet transporting path toward the finishing apparatus 20 provided on the downstream side, by the first transport rollers 12 and the second transport rollers 13, under the control of the controller 200.

FIGS. 4A to 4D are views for explaining an operation of the finishing apparatus 20.

As shown in FIGS. 4A to 4D, in the finishing apparatus 20, a sheet S received by the receiving rollers 21 is transported by the exit rollers 23 in the Z1 direction. While being transported along the transport path between the receiving rollers 21 and the exit rollers 23, the sheet S is detected by the exit sensor 22. Moreover, while the exit sensor 22 is detecting that the sheet S is being transported along the transport path, the sub paddles 26 are in the retract position, which is the state shown in FIG. 4A.

Figure 4A:
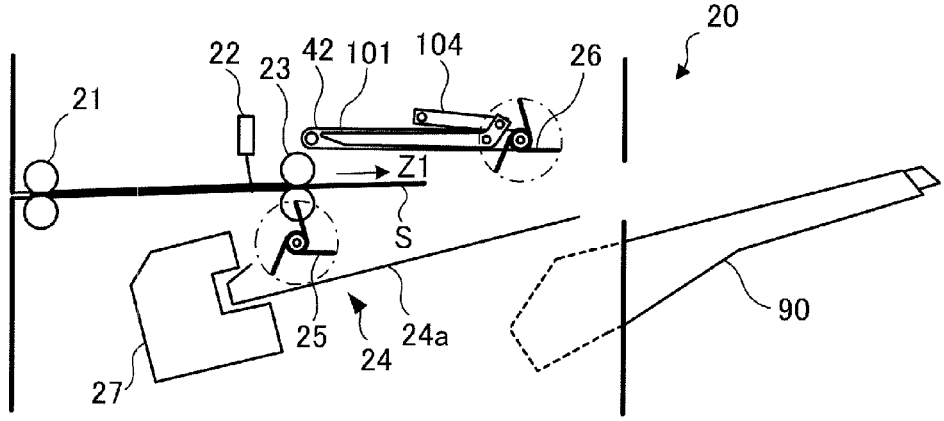
FIGS. 4A to 4D are views for explaining an operation of the finishing apparatus.
Figure 4B:
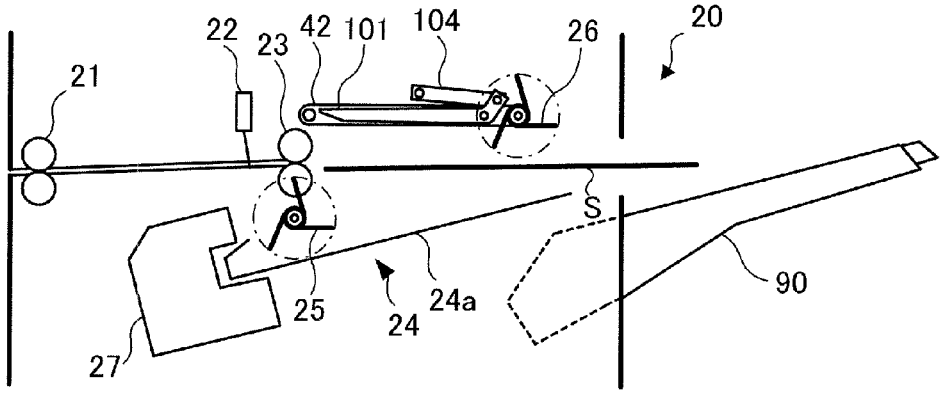
Figure 4C:
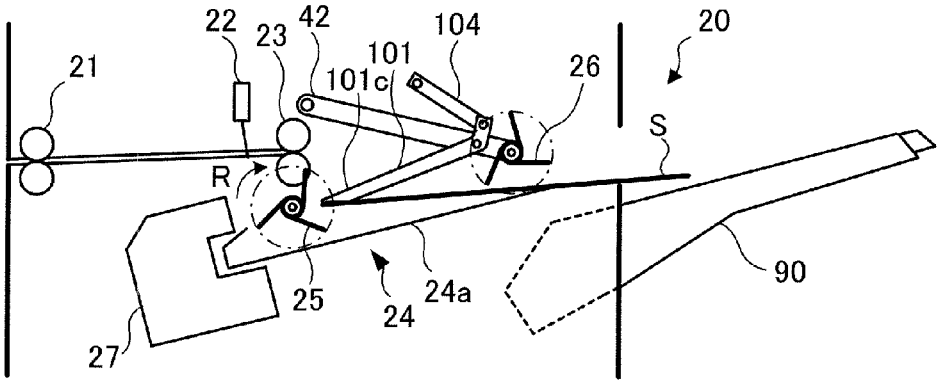
Figure 4D:
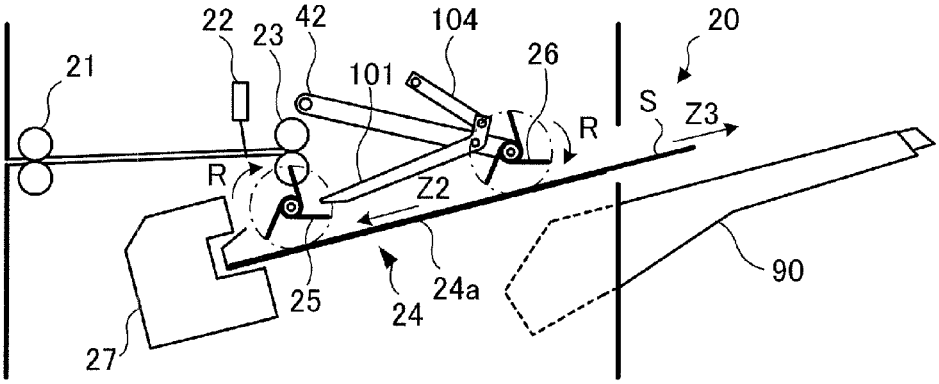

Then, as shown in FIG. 4B, the sheet S is outputted from the transport path by the exit rollers 23. When the exit sensor 22 detects that the sheet S has passed through the transport path, the sub paddles 26 are caused to move from the retract position to the contact position. Along with the movement of the sub paddles 26 from the retract position to the contact position, the tips of the sheet pressing members 101 tilt downward toward the sheet stacker 24*a* as shown in FIG. 4C. As the sheet pressing members 101 tilt downward, an end portion of the sheet S outputted by the exit rollers 23, which is closer to the end guide 24*b*, is pressed toward the sheet stacker 24*a* of the compile tray 24 by the tip portions (sheet pressing portions) 101*c*.

Then, the main paddles 25 rotate in the R direction in a state where the tip portions (sheet pressing portions) 101*c* press the end portion of the sheet S, which is closer to the end guide 24*b*. Thereby, while moving toward the sheet stacker 24*a* promptly, the sheet S moves toward the end guide 24*b*. Thereafter, by the rotations of the sub paddles 26 being in the contact position and the main paddles 25 in the R directions, the sheet S having reached the sheet stacker 24*a* of the compile tray 24 is pushed in the Z2 direction, and the trail edge of the sheet S hits against the end guide 24*b* and is thus aligned (the state shown in FIG. 4D). In addition, at the time when the sheet S reaches the end guide 24*b* after being received by the sheet stacker 24*a*, the above-mentioned tamper (not shown in the figure) moves in directions orthogonal to the sheet transporting direction to perform alignment of both ends of stacked sheets one by one.

Subsequently, a predetermined number of sheets are received on the compile tray 24 and then aligned, so that a sheet bundle is produced. When the sheet bundle is produced on the compile tray 24, the second eject rollers 28*b* of the eject rollers 28 (refer to FIG. 2) move from the retract position to the output position. Then, the sheet bundle is subjected to the staple processing by the stapler 27 caused to be moved to a position in accordance with the target binding position.

Thereafter, by the rotations of the first eject rollers 28*a* and the second eject rollers 28*b*, the sheet bundle is outputted toward the stacker tray 90. In this manner, the sheet bundle thus bound is stacked on the stacker tray 90.

FIGS. 8A to 8D are views showing an operation of another finishing apparatus 20 not including the sheet pressing mechanism 100 included in the finishing apparatus 20 according to the first exemplary embodiment.

Figure 8A:
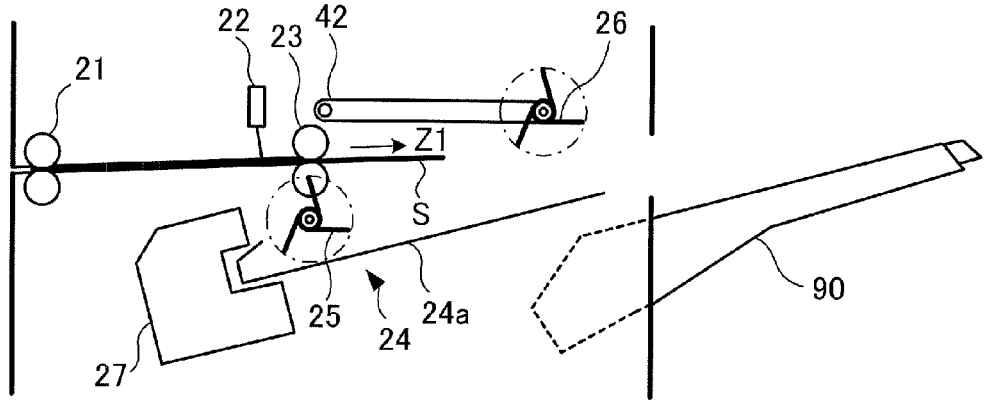
FIGS. 8A to 8D are views showing an operation of another finishing apparatus not including the sheet pressing mechanism included in the finishing apparatus according to the first exemplary embodiment.
Figure 8B:
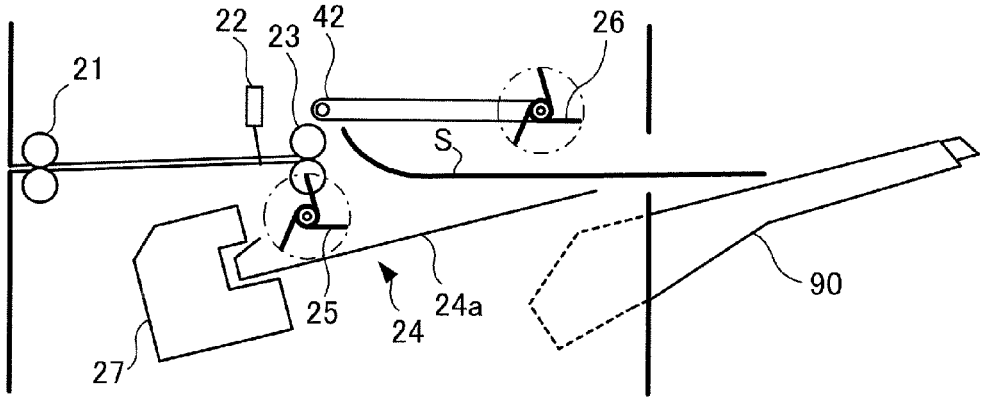
Figure 8C:
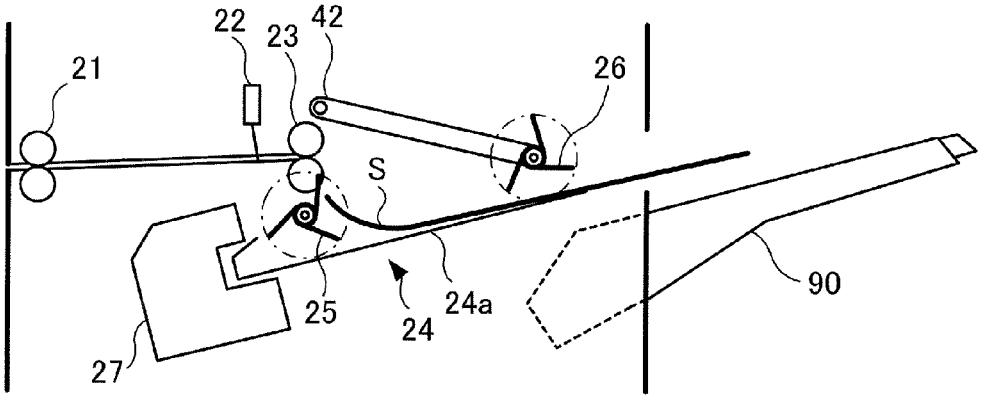
Figure 8D:
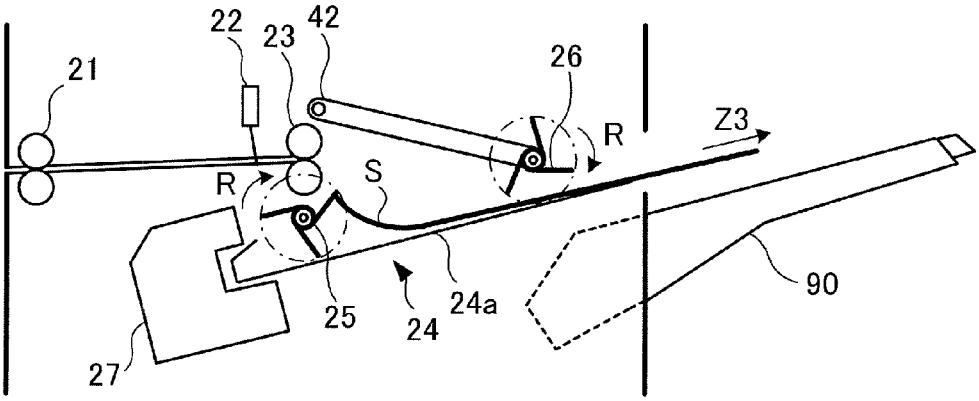

As shown in FIGS. 8A to 8C, a trail edge of the sheet S outputted from the transport path by the exit rollers 23 may be curled up or turned up due to static electricity. In such a case, the sheet contact portions 25*a* of the main paddles 25 (refer to FIG. 2) is likely to push the trail edge of the sheet S, so that the sheet S is pushed back in a Z3 direction, as shown in FIG. 8D. In this case, the sheet S may fall down to the stacker tray 90, or alignment of the predetermined number of sheets may not be always performed smoothly.

By contrast, in the finishing apparatus 20 according to the first exemplary embodiment, even when a trail edge of the sheet S outputted by the exit rollers 23 is curled up or turned up due to static electricity, the sheet pressing members 101 of the sheet pressing mechanism 100 press the trail edge of the sheet S. Moreover, the sheet pressing members 101 press the sheet S toward the sheet stacker 24*a* immediately after the sheet S is outputted from the transport path by the exit rollers 23.

In addition, the sheet pressing mechanism 100 has a simple configuration in which the sheet pressing members 101 are supported by the sub paddle supporting members 42 supporting the sub paddles 26 and thus tilt toward the sheet stacker 24*a* in conjunction with the movements of the sub paddles 26 from the retract position to the contact position.

Second Exemplary Embodiment

Figure 5:
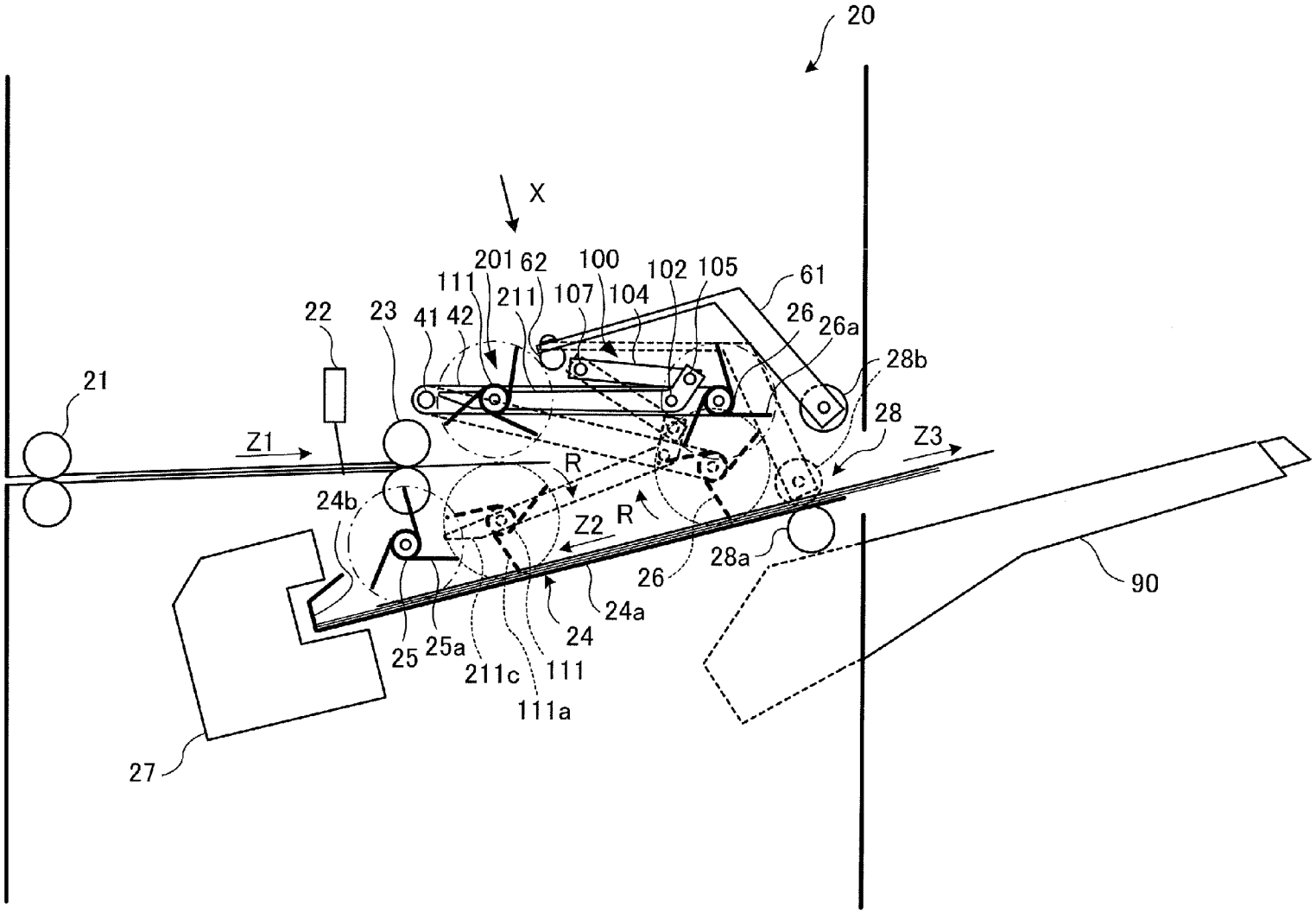
FIG. 5 is a view showing a configuration of the finishing apparatus according to a second exemplary embodiment.
Figure 6:
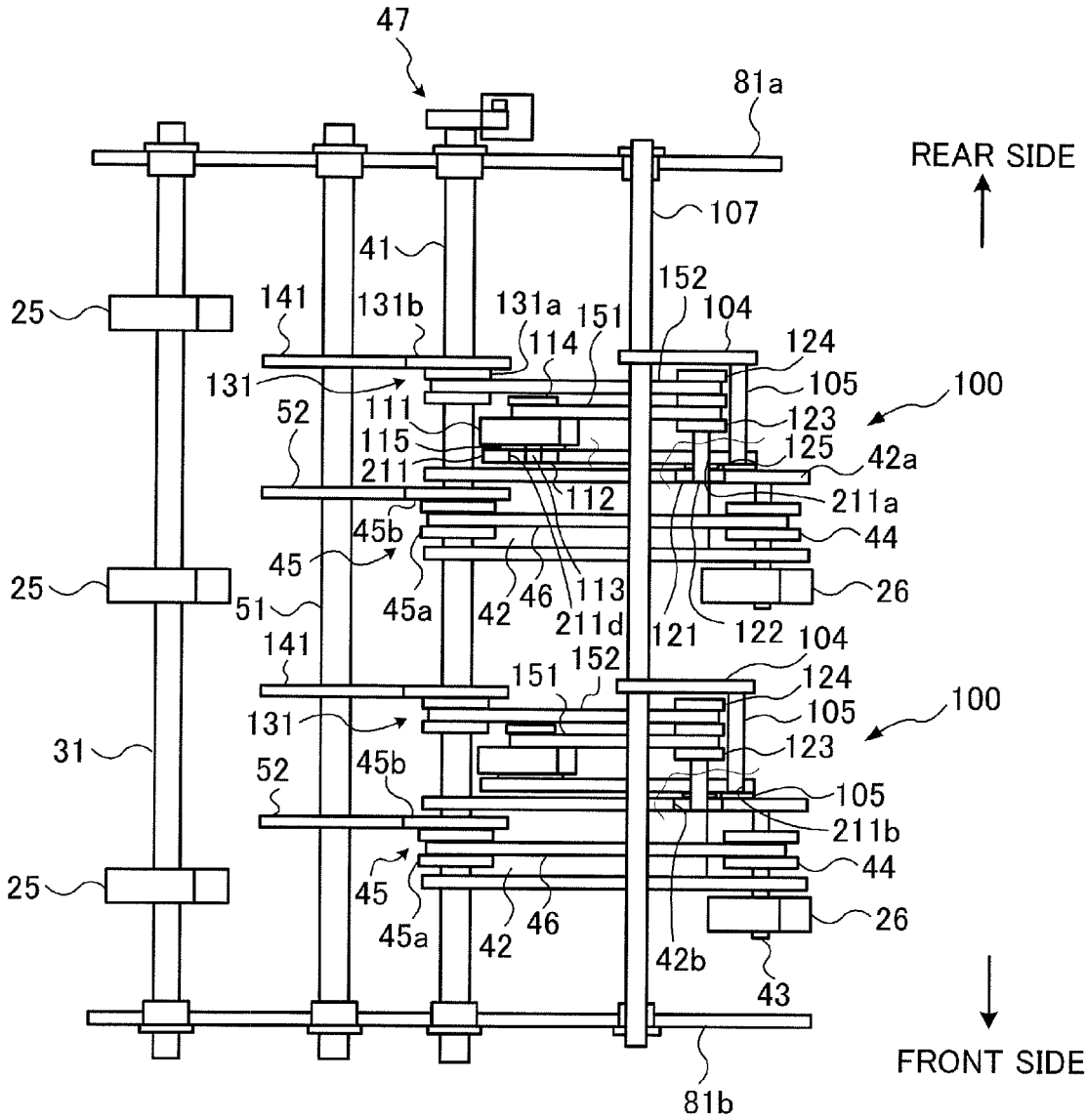
FIG. 6 is a view for explaining the configuration of the finishing apparatus in the direction orthogonal to the sheet transporting direction, and is a view principally taken in an arrow X direction in FIG. 5.

FIG. 5 is a view showing a configuration of the finishing apparatus 20 according to a second exemplary embodiment. FIG. 6 is a view for explaining the configuration of the finishing apparatus 20 in the direction orthogonal to the sheet transporting direction, and is a view principally taken in an arrow X direction in FIG. 5.

In the second exemplary embodiment, the sheet pressing mechanism 100 is provided with third paddles 111, as will be described later. The rest of the configuration is the same as that according to the first exemplary embodiment. Accordingly, the same members as those in the first exemplary embodiment are denoted by the same reference numerals, and the detailed descriptions of those members will be omitted below. It should be noted that, to make the configurations of the sheet pressing mechanism 100 and the third paddles 111 easy to understand, the sheet pressing mechanism 100 and the third paddle ill are shown on the front side compared to the sub paddle supporting member 42 in FIG. 5. The exact positional relationships in the direction orthogonal to the sheet transporting direction between the sheet pressing mechanism 100 and each of the third paddles 111, the sub paddle supporting members 42 as well as the main paddles 25, for example, are as shown in FIG. 6. In FIG. 6, the second eject rollers 28*b*, the second eject roller supporting members 61, the second eject roller supporting shaft 62 and the second eject roller swinging member 63 are omitted.

As shown in FIGS. 5 and 6, sheet pressing members 201 of the sheet pressing mechanisms 100 each include the third paddle 111 closer to a tip portion (sheet pressing portion) 211*c* of a corresponding sheet pressing member main body 211. The third paddles 111 each include three flexible sheet contact portions 111*a* that are the same as those of the main paddles 25 and the sub paddles 26, and are for transporting a sheet toward the end guide 24*b* by coming into contact with a top surface of the sheet (or the uppermost surface of a sheet bundle) on the sheet stacker 24*a*. In other words, the third paddles 111 are an example of a third moving and pressing unit for moving and pressing a sheet toward the end guide 24*b* on the sheet stacker 24*a*, and are also an example of a third moving and pressing member for moving and pressing a sheet toward the end guide 24*b* on the sheet stacker 24*a* by rotating while being in contact with the sheet.

Moreover, the third paddles 111 are rotatably attached to the respective sheet pressing member main bodies 211, and are disposed between the main paddles 25 and the sub paddles 26 when the sub paddles 26 are in the contact position (the position indicated by broken lines in FIG. 5), to transport the sheet toward the end guide 24*b* by coming into contact with a top surface of the sheet on the sheet stacker 24*a* together with the main paddles 25 and the sub paddles 26.

More specifically, the sheet pressing members 201 each include a hole portion 211*d* formed in the tip portion 211*c* of the corresponding sheet pressing member main body 211 (refer to FIG. 6). A bearing 112 is press-fitted into the hole portion 211*d* formed in the sheet pressing member main body 211, and a third-paddle support shaft 113 is press-fitted into a hole portion formed in the bearing 112, as shown in FIG. 6. The third paddles ill are press-fitted around the third-paddle support shaft 113, and are thereby fixedly supported by the third-paddle support shaft 113. Moreover, first pulleys 114 are also press-fitted around the third-paddle support shaft 113, and are thereby fixedly supported by the third-paddle support shaft 113. A washer 115 is inserted between the sheet pressing member main body 211 and each of the third paddles 111.

Meanwhile, a bearing 121 is press-fitted around each of the sub paddle supporting members 42, and a sheet pressing member supporting shaft 122 is pressed-fitted into a hole portion formed in the bearing 121. The sheet pressing member main bodies 211 are loosely fitted around the sheet pressing member supporting shaft 122. Moreover, second pulleys 123 are press-fitted around the sheet pressing member supporting shaft 122 in a position corresponding to the respective first pulleys 114, and are thereby fixedly supported by the sheet pressing member supporting shaft 122. Furthermore, third pulleys 124 are also press-fitted around the sheet pressing member supporting shaft 122, and are thereby fixedly supported by the sheet pressing member supporting shaft 122. A washer 125 is inserted between each of the sheet pressing member main bodies 211 and the corresponding sub paddle supporting member 42.

Fourth pulleys 131 each including a pulley portion 131*a* and a gear portion 131*b* are press-fitted around the sub paddle support shaft 41, and are fixedly supported by the sub paddle support shaft 41 so that the pulley portions 131*a* are disposed in positions corresponding to the respective first pulleys 114. Drive gears 141 engaged with the respective gear portions 131*b* of the fourth pulleys 131 are fixedly supported by the sub paddle drive shaft 51.

A first belt 151 is stretched between each of the first pulleys 114 and the corresponding second pulley 123, and a second belt 152 is stretched between each of the third pulleys 124 and the corresponding one of the pulley portions 131*a* of the fourth pulleys 131. Accordingly, the third paddles 111 are driven by the first belts 151 provided for driving the third paddles 111.

Next, a description will be given of an operation of the finishing apparatus 20 according to the second exemplary embodiment, which has the above-described configuration.

FIGS. 7A to 7D are views for explaining an operation of the finishing apparatus 20 according to the second exemplary embodiment.

Figure 7A:
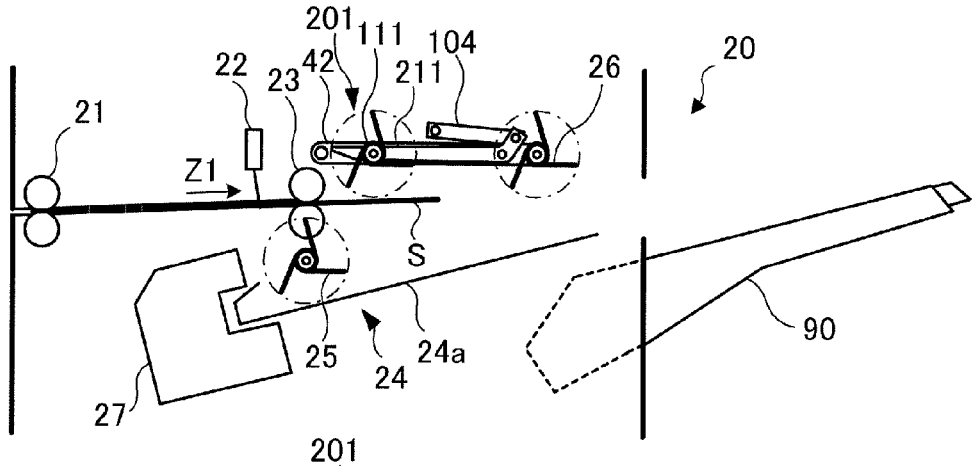
FIGS. 7A to 7D are views for explaining an operation of the finishing apparatus according to the second exemplary embodiment.

As shown in FIGS. 7A to 7D, in the finishing apparatus 20, while the exit sensor 22 is detecting that the sheet is being transported along the transport path between the receiving rollers 21 and the exit rollers 23, the sub paddles 26 are in the retract position, which is the state shown in FIG. 7A.

Figure 7B:
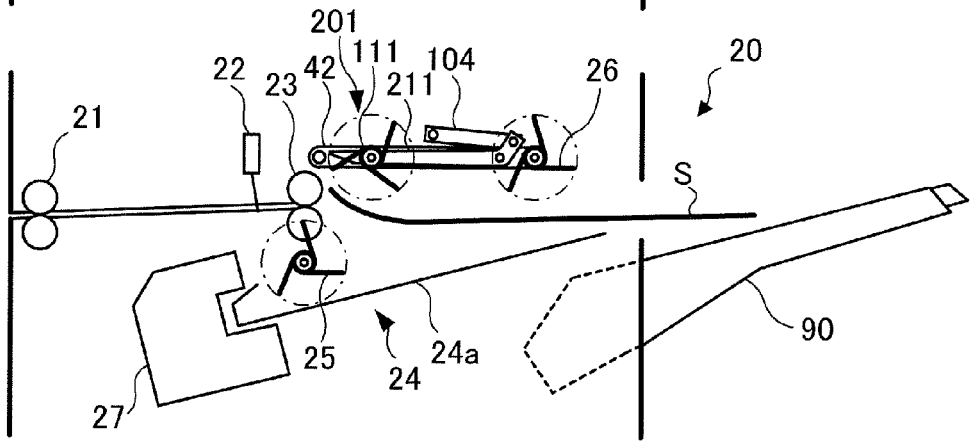
Figure 7C:
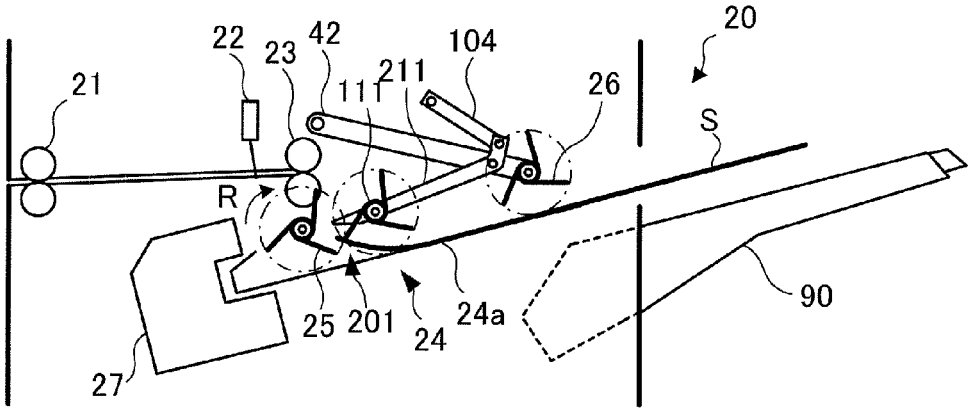
Figure 7D:
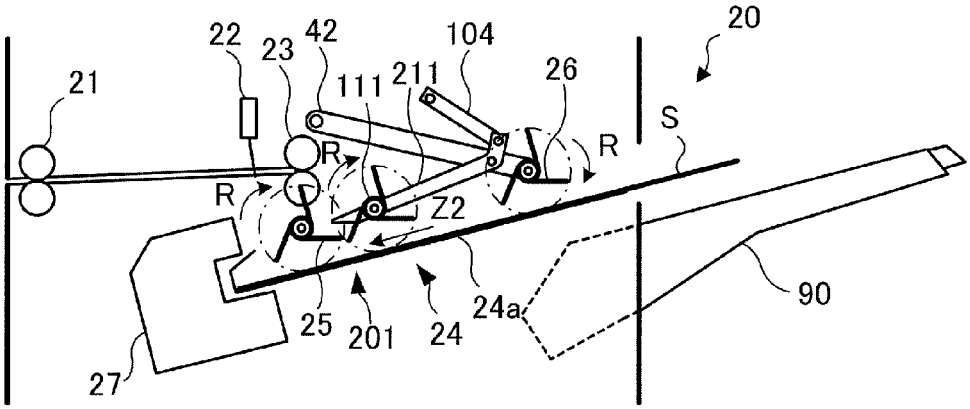

Then, as shown in FIG. 7B, the sheet S is outputted from the transport path by the exit rollers 23. When the exit sensor 22 detects that the sheet has passed through the transport path, the sub paddles 26 are caused to move from the retract position to the contact position. Along with the movement of the sub paddles 26 from the retract position to the contact position, the tips of the sheet pressing member main bodies 211 tilt downward toward the sheet stacker 24*a* as shown in FIG. 7C.

Along with the movement of the sheet pressing member main bodies 211, the third paddles 111 also move toward the sheet stacker 24*a*. As the sheet pressing members 201 tilt downward, an end portion of the sheet S outputted by the exit rollers 23, which is closer to the end guide 24*b*, is pressed toward the sheet stacker 24*a* of the compile tray 24 by the sheet pressing members 201.

Then, the main paddles 25 rotate in the R direction in a state where the sheet pressing members 201 press the end portion of the sheet S, which is closer to the end guide 24*b*. Thereby, while moving toward the sheet stacker 24*a* promptly, the sheet S moves toward the end guide 24*b*. Thereafter, by the rotations of the sub paddles 26 being in the contact position and the main paddles 25 in the R directions, and the rotation of the third paddles 111 in the R direction, the sheet S having reached the sheet stacker 24*a* of the compile tray 24 is pushed in the Z2 direction, and the trail edge of the sheet S hits against the end guide 24*b* and is thus aligned (the state shown in FIG. 7D). In addition, at the time when the sheet S reaches the end guide 24*b* after being received by the sheet stacker 24*a*, the above-mentioned tamper not shown in the figure) moves in directions orthogonal to the sheet transporting direction to perform alignment of both ends of stacked sheets one by one.

Subsequently, a predetermined number of sheets are received on the compile tray 24 and then aligned, so that a sheet bundle is produced. When the sheet bundle is produced on the compile tray 24, the second eject rollers 28*b* of the eject rollers 28 move from the retract position to the output position. Then, the sheet bundle is subjected to the binding processing by the stapler 27 caused to be moved to a position in accordance with the target binding position.

Thereafter, by the rotations of the first eject rollers 28*a* and the second eject rollers 28*b*, the sheet bundle is outputted toward the stacker tray 90. In this manner, the sheet bundle thus bound is stacked on the stacker tray 90.

As described above, in the finishing apparatus 20 according to the second exemplary embodiment, as in the finishing apparatus 20 according to the first exemplary embodiment, the sheet pressing members 201 of the sheet pressing mechanism 100 press the trail edge of the sheet S outputted by the exit rollers 23. Moreover, the sheet pressing members 201 press the sheet S toward the sheet stacker 24*a* immediately after the sheet S is outputted from the transport path by the exit rollers 23. In addition, the finishing apparatus 20 according to the second exemplary embodiment includes the third paddles 111, and hence pushes the sheet S on the sheet stacker 24*a* toward the end guide 24*b* by using the third paddles 111 together with the main paddles 25 and the sub paddles 26.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A finishing apparatus comprising:

an output unit that outputs a recorded sheet on which an image is recorded;

a sheet stacker that receives the recorded sheet from the output unit and on which the recorded sheet is stacked;

a reference surface against which the recorded sheet on the sheet stacker is aligned;

a binding unit that binds a bundle of the recorded sheets aligned against the reference surface;

a sheet pressing member that presses an end portion of the recorded sheet toward the sheet stacker, the end portion being closer to the reference surface;

a first moving and pressing unit that moves the recorded sheet toward the reference surface while the sheet pressing member presses the end portion of the recorded sheet, the end portion being closer to the reference surface; and a second moving and pressing unit that is movable, and that is in a first position while the output unit is outputting the recorded sheet and is in a second position while the recorded sheet is being moved toward the reference surface after output of the recorded sheet.

2. The finishing apparatus according to claim 1, further comprising:

a drive mechanism that moves the second moving and pressing unit from one to the other of the first position and the second position, wherein the sheet pressing member operates in conjunction with the drive mechanism.

3. The finishing apparatus according to claim 2, wherein the drive mechanism includes a supporting member that supports and swings the second moving and pressing unit, and the sheet pressing member is coupled to the supporting member.

4. The finishing apparatus according to claim 1, wherein the first position is a position in which the second moving and pressing unit does not obstruct the output of the recorded sheet when the output unit outputs the recorded sheet, and the second position is a position in which, after the output of the recorded sheet by the output unit, the second moving and pressing unit is in contact with the recorded sheet, moves the recorded sheet toward the reference surface, and presses the recorded sheet against the reference surface.

5. The finishing apparatus according to claim 1, wherein the sheet pressing member is positioned not to interfere with the recorded sheet outputted from the output unit, when the second moving and pressing unit is in the first position, and the sheet pressing member comes into contact with the recorded sheet and presses the recorded sheet toward the sheet stacker as the second moving and pressing unit moves from the first position to the second position.

6. The finishing apparatus according to claim 1, wherein an end of the sheet pressing member is positioned more distant from a stacking surface of the sheet stacker than the output unit in a direction orthogonal to the stacking surface when the second moving and pressing unit is in the first position, while the end of the sheet pressing member is positioned closer to the stacking surface than the output unit in the direction orthogonal to the stacking surface when the second moving and pressing unit is in the second position, the stacking surface stacking the recorded sheet thereon.

7. The finishing apparatus according to claim 1, wherein the first moving and pressing unit includes a plurality of moving and pressing members that are provided so as to be spaced from each other in a direction orthogonal to an output direction of the recorded sheet, and that move the recorded sheet toward the reference surface and press the recorded sheet against the reference surface by their own rotation, and a tip portion of the sheet pressing member is arranged between the plurality of moving and pressing members in the direction orthogonal to the output direction of the recorded sheet, while overlapping with rotation areas of the plurality of moving and pressing members in a moving direction of the recorded sheet on the sheet stacker toward the reference surface.

8. The finishing apparatus according to claim 1, wherein the sheet pressing member includes a third moving and pressing unit that moves the recorded sheet toward the reference surface and presses the recorded sheet against the reference surface on the sheet stacker.

9. A finishing apparatus comprising:

an output roller that outputs a recorded sheet on which an image is recorded;

a sheet stacker that receives the recorded sheet outputted by the output roller and on which the recorded sheet is stacked;

a reference surface that is formed perpendicular to a stacking surface of the sheet stacker, on which the recorded sheet is stacked;

a first moving and pressing member that moves the recorded sheet toward the reference surface and presses the recorded sheet against the reference surface by coming into contact with the recorded sheet on the sheet stacker and rotating;

a binding unit that binds a bundle of the recorded sheets aligned against the reference surface;

a rotation shaft that is rotatably supported by an apparatus main body in a position more distant from the stacking surface than the output roller in a direction orthogonal to the stacking surface;

a first rotation member that has one end portion fixedly supported by the rotation shaft, and that rotates together with the rotation shaft;

a second moving and pressing member that is rotatably supported by the other end portion of the first rotation member, and that moves the recorded sheet toward the reference surface and presses the recorded sheet against the reference surface by coming into contact with the recorded sheet on the sheet stacker and rotating;

a second rotation member that has one end portion rotatably supported by a fixed shaft fixed to the apparatus main body, and rotates about the fixed shaft; and a sheet pressing member that includes a first supporting portion rotatably supported by the first rotation member, a second supporting portion rotatably supported by the other end portion of the second rotation member, and a sheet pressing portion being in a position opposite to the second supporting portion with respect to the first supporting portion.

10. The finishing apparatus according to claim 9, wherein when the second moving and pressing member rotates about the rotation shaft together with the first rotation member and comes into contact with the recorded sheet on the sheet stacker, the sheet pressing portion of the sheet pressing member rotates about the first supporting portion and moves toward the stacking surface in association with the rotation and contact of the second moving and pressing member.

11. A sheet processing system comprising:

an image forming apparatus that forms an image on a sheet;

a sheet stacker that receives the sheet on which the image is formed by the image forming apparatus, and on which the sheet is stacked;

a reference surface against which the sheet on the sheet stacker is aligned;

a binding unit that binds a bundle of the sheets aligned against the reference surface;

a sheet pressing member that presses an end portion of the sheet toward the sheet stacker, the end portion being closer to the reference surface;

a first moving and pressing unit that moves the sheet toward the reference surface while the sheet pressing member presses the end portion of the sheet, the end portion being closer to the reference surface; and a second moving and pressing unit that is movable, and that is in a first position while an output unit is outputting the recorded sheet and is in a second position while the recorded sheet is being moved toward the reference surface after output of the recorded sheet.

12. A sheet alignment method for a finishing apparatus including an output unit that outputs a recorded sheet on which an image is recorded; a sheet stacker that receives the recorded sheet from the output unit and on which the recorded sheet is stacked; a reference surface against which the recorded sheet on the sheet stacker is aligned; a binding unit that binds a bundle of the recorded sheets aligned against the reference surface; a sheet pressing member that presses an end portion of the recorded sheet toward the sheet stacker, the end portion being closer to the reference surface; a first moving and pressing unit that moves the recorded sheet toward the reference surface, a second moving and pressing unit that is movable, and that is in a first position while an output unit is outputting the recorded sheet and is in a second position while the recorded sheet is being moved toward the reference surface after output of the recorded sheet, the sheet alignment method comprising:

pressing the end portion of the recorded sheet toward the sheet stacker by the sheet pressing member, the end portion being closer to the reference surface; and moving the recorded sheet toward the reference surface by the first moving and pressing unit and the second moving and pressing unit while the sheet pressing member presses the end portion of the recorded sheet, the end portion being closer to the reference surface.

13. The finishing apparatus according to claim 1, wherein the first moving and pressing unit that moves the recorded sheet toward the reference surface and presses the recorded sheet against the reference surface by coming into contact with the recorded sheet on the sheet stacker and rotating;

the second moving and pressing unit connected to a connecting member that changeable position toward the sheet stacker, and that moves the recorded sheet toward the reference surface and presses the recorded sheet against the reference surface by coming into contact with the recorded sheet on the sheet stacker and rotating; and the sheet pressing member connected to the connecting member that changeable position toward the sheet stacker and presses an end portion of the recorded sheet toward the sheet stacker, wherein the first moving and pressing unit and the sheet pressing member is between the reference surface and the second moving and pressing unit, while the first moving and pressing unit is positioned closer to the reference surface than the sheet pressing member.

14. A finishing apparatus comprising:

an output unit that outputs a recorded sheet;

a sheet stacker that receives the recorded sheet;

a reference surface that is formed perpendicular to a stacking surface of the sheet stacker;

a first moving and pressing unit that presses and conveys the recorded sheet toward the reference surface;

a sheet pressing member that is a bar or a plate; and a second moving and pressing unit that presses and conveys the recorded sheet toward the reference surface, wherein the first moving and pressing unit touches the recorded sheet while the sheet pressing member pushes an end part of the recorded sheet toward the sheet stacker.

* * * * *